US005653770A

United States Patent [19]

Goldstein et al.

[11] Patent Number: 5,653,770

[45] Date of Patent: Aug. 5, 1997

[54] ANTIQUE-LOOKING AND FEELING FABRICS AND GARMENTS AND METHOD OF MAKING SAME

[75] Inventors: Eric Goldstein, Roseland; Randolph Finley, Upper Montclare, both of N.J.

[73] Assignee: Polo Ralph Lauren Corporation, New York, N.Y.

[21] Appl. No.: 104,977

[22] Filed: Aug. 11, 1993

[51] Int. Cl.[6] ..... D06P 5/04; D06M 13/02; D06M 13/08

[52] U.S. Cl. ..... 8/114; 8/483; 8/492; 8/614; 8/618; 8/938; 2/69

[58] Field of Search ..... 8/441, 550, 495, 8/483, 614, 618, 938, 492, 102, 108 A; 2/22, 51, 69, 77, 78 B, 79, 92, 93, 94, 95, 102, 103, 108, 211, 214, 227, 234, 237, 279

[56] References Cited

U.S. PATENT DOCUMENTS

| | | | |
|---|---|---|---|
| 3,523,749 | 8/1970 | MacLeod et al. | 8/54.2 |
| 3,765,840 | 10/1973 | Durr et al. | 8/175 |
| 3,783,650 | 1/1974 | Weber et al. | 68/18 |
| 3,784,355 | 1/1974 | Fielding | 8/175 |
| 3,806,315 | 4/1974 | Rosenbaum | 8/94 |
| 3,986,824 | 10/1976 | Waibel et al. | 8/14 |
| 4,080,165 | 3/1978 | Thompson | 8/158 |
| 4,111,645 | 9/1978 | Zurbuchen et al. | 8/1 W |
| 4,218,220 | 8/1980 | Kappler et al. | 8/102 |
| 4,243,391 | 1/1981 | Puchta et al. | 8/111 |
| 4,575,887 | 3/1986 | Viramontes | 8/158 |
| 4,601,845 | 7/1986 | Namnath | 252/99 |
| 4,740,213 | 4/1988 | Ricci | 8/108.1 |
| 5,082,468 | 1/1992 | Hopkins | 8/477 |

OTHER PUBLICATIONS

Encyclopedia of Chemical Technology, Third ed., vol. 8, 1979, pp. 280–350.

In ve Thorpe et al, 227 USPQ 964.

In ve Fitzgerald et al, 205 USPQ 594.

*Primary Examiner*—Gary Geist

*Attorney, Agent, or Firm*—Amster, Rothstein & Ebenstein

[57] ABSTRACT

This invention is directed to a method of treating fabrics and garments so as to impart onto said fabrics and garments an antique or vintage look and feel. This invention is further directed to antique-looking and feeling fabrics and garments.

13 Claims, No Drawings

ANTIQUE-LOOKING AND FEELING FABRICS AND GARMENTS AND METHOD OF MAKING SAME

FIELD OF THE INVENTION

This invention relates to fabrics and garments which have an antique or vintage look and feel, and to a method of making said fabrics and garments. Specifically, this invention is directed to a method of making antique-looking fabrics and garments utilizing a hydrocarbon-based or chlorinated dry cleaning solvent and a solvent-based stain in a dry cleaning machine, such that the new fabric or garment is made to have an antique appearance and feel. This invention is further directed to antique-looking fabrics and garments.

BACKGROUND OF THE INVENTION

It is typical practice within the garment industry to treat garments so as to impart particular properties and characteristics to said garments. In particular, garments are often treated so as to impart on said garments particular looks which may be fashionable. Garments which are treated are typically subjected to chemical treatments and dyeing so as to make the garments more appealing.

By way of example, U.S. Pat. No. 4,740,213 issued Apr. 26, 1988 to Ricci entitled "Method of Producing A Random Faded Effect on Cloth or Made-Up Garments, and the End-Product Obtained by Implementation of Such a Method" ("the '213 Patent") is directed to a method of fading cloth wherein cloth is put into dry contact with pumice granules that are impregnated with a chemical bleaching agent in a drum which is rotated for a preset period of time. By utilizing material having powerful bleaching properties and tumbling granules and cloth together in a rotating drum, the garments produced by the method described in the '213 Patent are made to have a uniformly faded appearance.

U.S. Pat. No. 4,111,645 issued Sep. 5, 1978 to Zurbuchen et al. entitled "Fine Particle Application of Dyes or Optical Brightener to Leathers or Fabrics In a Tumbling Drum At Low Volume in a Hydrophobic Solvent" ("the '645 Patent") teaches an improved process for the dyeing of organic material, particularly synthetic organic material, from organic solvents with application of a short goods-to liquor ratio. Garments treated by the method described in the '645 Patent have the appearance of being uniformly dyed.

U.S. Pat. No. 4,080,165 issued Mar. 21, 1978 to Thompson entitled "Piece Goods Dyer and Process of Dyeing" ("the '165 Patent") is directed to a process and a machine particularly suited for dyeing at a low liquid-to goods ratio for synthetic fibers. The process and apparatus disclosed in the '165 Patent obviate the problems of non-uniform coloring and non-uniform shading of garments. Garments subjected to the process and apparatus of the '165 Patent are made to have the appearance of uniform coloring and uniform shading.

U.S. Pat. No. 3,806,315 issued Apr. 23, 1974 to Rosenbaum et al. entitled "Solvent Dyeing with Aqueous Perchloroethylene-Hydrocarbon Mixture and Recovery of the Solvents After Dyeing" ("the '315 Patent") is directed to a method for dyeing fabrics employing a conventional dyeing operation with the exception that the dye-bath utilized employs a two-phase system. In this system, the dye is dissolved in a minimum amount of water which contains an inert water-immicisble solvent in an amount to make up the total volume of the dye-bath. At the completion of the dyeing operation, the excess dye in dyeing adjuvants, being insoluble in the organic solvent, remain in the aqueous phase. The solvent can then be readily recovered from the spent dye-bath by mechanical separation without change of state. Garments produced by the method described in the '315 Patent are thus dyed using a minimum amount of water.

U.S. Pat. No. 3,784,355 issued Jan. 8, 1974 to Fielding entitled "Solvent Dyeing or Solvent Creaseproofing with Steam and Solvent Vapor Dyeing" ("the '355 Patent") is directed to a process for applying a finishing agent to a substrate comprising treating a substrate with a solution, dispersion or emulsion of the finishing agent in an organic solvent and then treating the substrate with steam to remove the organic solvent, and subsequently treating the substrate with superheated steam or vapor of the organic solvent. Garments treated by the method described in the '355 Patent have specific properties, such as crease resistance, water repellancy and soil resistance by substrates such as textile materials, paper or plastic.

U.S. Pat. No. 3,765,840 issued Oct. 16, 1973 to Durr et al. entitled "Process for Controlling the Temperature of a Dyeing Mixture" ("the '840 Patent") is directed to an apparatus and a method of dyeing textiles comprising subjecting textiles to a treatment mixture containing two or more liquids, heating the mixture to obtain rapid vaporization of the liquid, condensing the resulting vapors and directing at least a portion of the condensate away from the treating mixture until the temperature of the dyeing mixture increases to a desired level. Garments treated by the methods disclosed in the '840 Patent are uniformly dyed.

To date, no method has been developed for treating garments, particularly denim garments, such that the garments have an antique-like look and feel. According, it is an object of this invention to provide a method of treating garments so that said garments have an antique-looking appearance and feel. It is a further object of this invention to provide antique-looking garments.

SUMMARY OF THE INVENTION

This invention is directed to a method of producing antique-looking fabrics and garments, including denim fabrics and garments, wherein said fabrics and garments are stained in a substantially moisture-free dry cleaning machine with a hydrocarbon-based or chlorinated dry cleaning solvent and a solvent-based stain. The solvent-stain mixture in the processed fabrics and garments is then extracted (i.e., removed) to approximately 50–60% wet pickup (the weight of solvent divided by the weight of fabric, multiplied by 100) and the fabrics and garments are then dried in a forced hot air environment, such as steam drying, so as to set the stain. The stained fabrics and garments may then be washed and dried a second time. This invention is further directed to antique-looking fabrics and garments.

DETAILED DESCRIPTION OF THE INVENTION

Although it is well known in the garment industry to treat fabrics and garments so as to make fabrics and garments look faded, uniformly dyed, colored or shaded, or to make fabrics and garments crease resistant, water repellant or soil resistant, no comparable method of producing antique-looking and feeling fabrics and garments is known. This invention is directed to antique-looking and feeling fabrics and garments which are durable, and to a method of producing durable fabrics and garments which have an antique look and feel.

Types of fabrics or garments to be treated by the method of this invention are unlimited. The method of this invention can be applied to any type of fabric, animal skin or hair or garment with any construction or any fiber content. By way of example, types of fabrics and garments which may be treated by the method of this invention include cotton, wool, rayon, polyester and even leather and horsehair. Denim is a preferred fabric of this invention. Further, the method of this invention has minimal impact on shrinkage of the fabrics and garments to be treated.

The fabrics and garments of this invention are made to have an antique appearance and feel by staining the fabric or garment with a hydrocarbon-based or chlorinated dry cleaning solvent and a solvent-based stain in a petroleum dry cleaning machine which is substantially free of moisture, extracting the processed fabric or garment and drying the extracted fabric or garment in a forced hot air environment, such as steam drying, so as to set in the petroleum-based stain.

Preferred solvents to be used are Stoddard solvent and perchloroethylene. Preferably, the solvent to be used is at room temperature, however, temperature of the solvent should range from about 65°–150° F. A solvent-based stain may be selected from the group consisting of Miniwax 210B, EVENTONE GOLDEN OAK, polyurethane and solvent dyes, and may be adjusted to the desired color and depth of color. Typically, the stain:solvent ratio is about 1:10. However, the stain:solvent ratio can be in the range of about 1:30 to 1:5, depending on the shade desired and the combination of colorants used in the stain mixture. The fabric:solvent ratio is preferably about 1:5. However, the range can be as low as about 1:3 and as high as about 1:50 without adverse results.

Optimally, when the fabrics and garments of this invention are stained, the dry cleaning machine is loaded so as to allow for full wetting of the fabric or garment. The fabric or garment, solvent and stain are agitated or submerged in the dry cleaning machine for a period necessary for full saturation of the fabric or garment, such as for a period of from about 2 to 30 minutes, and preferably for about 10 minutes. Since the staining is performed in a closed system, the stain can be recovered and re-used. Subsequent extraction of the fabric or garment is performed so as to remove excess solvent and stain to a wet pickup of between about 30% and about 150%, and preferably about 50 to 60%. For example, extraction may be performed for a period of about 15 seconds.

The extracted fabric or garment is then dried in order to set the stain into the fabric or garment. The time period for drying the extracted fabric or garment will vary, depending on the size of the dry cleaning machine used, the temperature at which the fabric or garment is dry cleaned, the amount of solvent extracted from the garments, and the type of dry cleaning machine used. However, the extracted fabric or garment should be dried in a forced hot air environment, such as steam drying, so that the temperature of the fabric or garment is extremely hot. The fabric or garment should be steam dried until the binder system causes the colorants in the stain to become fixed to the substrate. The fabric or garment should be made as dry as possible.

For the drying step, the fabric or garment may be steam dried in a Petro-Mizer, which allows for reclaiming of the solvent up to about 95%. If a Petro-Mizer machine is used, the fabric or garment should reach or exceed a temperature of about 210°.

In order to remove excess petroleum and residual odor from the treated fabric or garment, the fabric or garment may be washed. Preferably, the treated fabric or garment is washed in a cycle of about 10 minutes, containing two rinse cycles, wherein the temperature is about 120° F. Neutral soap should be used to wash the fabric or garment.

Fabrics or garments that have been washed may then be dried. The time and temperature utilized to dry the fabrics or garments will vary according to the fabric or garment itself. The washing and drying steps may be performed in a manner equivalent to home laundering.

Fabrics and garments treated by the method of this invention are antique in appearance, as they have an oxidized, yellow appearance, and are durable to laundering and dry cleaning refurbishment processes. Fabrics and garments treated by this method have a similar appearance to vintage garments. In addition, they have an antique feel to them.

EXAMPLE 1

A 45 pound Marvel Model #KSL-300-5B solvent cleaning machine was charged 45 pounds of indigo denim five pocket jeans that had been previously laundered to remove color and impart abraded light areas. A stain mix comprising 7 parts of EVENTONE GOLDEN OAK Stain (Davis Paint Company) and 93 parts of Mineral Spirits (Ashland Chemical Company) was prepared. Small amounts of CI Solvent Red 164 (1/3500th Percent) and Solvent Yellow (no CI Assignment) (2/3500th Percent) were added for casting purposes. For each pound of garment, 4.4 pounds of stain/solvent mixture was added to the machine. The garments were agitated for 5 minutes and the solvent was removed from the garments using centrifugal force necessary to produce a remaining solvent to fabric weight ratio of 50%. The garments were placed in a Hoyt Model PET SMA 105 Petro-Mizer steam dryer to remove the volatile components of the stain mixture for reuse. Garments were heated to 210° Fahrenheit to insure that the majority of the solvent had been removed and that the binding agents in the stain mix were completely reacted with the substrate. A subsequent laundering of the garments enabled any surface residue to be removed. This process produced garments with an antique look and feel durable to home washing and commercial dry cleaning processes.

EXAMPLE 2

As in Example 1, garments were processed as above, and agitated for 10 minutes, 15 minutes and 20 minutes. Bleached white unfinished fabric (8"×8" swatches) were added to each staining process to determine whether agitation time had any affect on stain pickup. Solvent was extracted from the garments to a weight ratio of 50% as in Example 1 and the shade of the white "rider" fabrics assessed. No significant shade difference was noted in either the rider fabric or the denim.

EXAMPLE 3

As in Example 1, garments were agitated for 5 minutes and the solvent was extracted from the garments at various extraction speeds. The amount of solvent/stain remaining in the garments varied from 40% to 80%. The garments and white "rider" swatches indicated that the garment and fabrics with 80% solvent/stain after drying were two and a half times darker than those garments with 40% solvent/stain remaining. No difference in stain durability was observed in either case. The lower solvent/stain ratios were advantageous because solvent removal time and curing were achievable at a more rapid rate. However, at the higher solvent concentration, greater color yield was observed.

EXAMPLE 4

As in Example 1, instead of Denim Cotton Indigo dyed jeans, samples of 100% cotton bleached white interlock knit shirts were processed and an antique stained shirt resulted. Similar trials were processed using garments constructed from woven cotton, wool, polyester, acrylic, linen and leather. In addition, belts constructed from horsehair were also processed. All showed various degrees of staining depending on the substrate and drying process.

EXAMPLE 5

As in Example 1, garments were stained for 5 minutes, extracted, and removed from the staining machine. Garments were dried for varying periods of time and removed at various intervals during the cycle to assess stain durability as a function of time and temperature. Fabric temperature was determined by heat tape attached to the garments prior to drying. Dryer temperature was measured directly by thermometer probes positioned in the exit discharged stacks prior to the condensors. Results are depicted below, and demonstrate that the bonding component in the stain mixture must reach a temperature of 210° Fahrenheit before the stain becomes fixed.

| TIME IN PETRO- | TEMPERATURE (deg F.) | | STAIN RETENTION |
|---|---|---|---|
| MIZER (min) | (Thermometer) | (Heat Tape) | AFTER LAUNDERING |
| 9 | 170 | 180 | 10% |
| 15 | 170 | 190 | 10% |
| 18 | 180 | 200 | 20% |
| 21 | 200 | 210 | 80% |
| 28 | 210 | 230 | 90% |

EXAMPLE 6

Example 1 was repeated using a chlorinated hydrocarbon (perchloroethylene) as the solvent medium. Garments were extracted and the perchloroethylene was removed from the garments using forced steam. The garments were removed from the "perc" machine with only the stain remaining on the garments. Several garments were heated in a forced steam dryer to a temperature of 210° Fahrenheit. The stain was found to be durable to repeated commercial launderings. Garments that were not heated after removal from the Marvel "perc" cleaning/staining machine displayed poor stain color retention following commercial laundering using detergent and water.

EXAMPLE 7

Garments were processed as in Example 1, except that the garments were dried and the stain cured with live steam. Garments with an antique look resulted which were durable to home laundering and dry cleaning.

Although the invention herein has been described with reference to particular embodiments, it is to be understood that these embodiments are merely illustrative of various aspects of the invention. Thus, it is to be understood that numerous modifications may be made in the illustrative embodiments and other arrangements may be devised without departing from the spirit and scope of the invention.

We claim:

1. A method of producing an antique looking and feeling fabric or garment which is durable to dry cleaning and home washing, comprising:

(a) staining said fabric or garment with a hydrocarbon-based dry cleaning solvent and a solvent-based stain in a petroleum dry cleaning machine substantially free of moisture for a period of time sufficient to fully saturate the fabric or garment;

(b) extracting said dry cleaned fabric or garment to remove excess solvent and stain to obtain a wet pickup in a desired range; and (c) drying said extracted fabric or garment in a forced hot air environment so as to set in the stain and cause the remaining solvent and stain to migrate to the surface of the fabric or garment.

2. The method of claim 1 wherein the fabric or garment is comprised of a material selected from the group consisting of denim, cotton, wool, rayon, polyester, linen, leather, horsehair and blends thereof.

3. The method of claim 1 wherein the solvent is Stoddard solvent or perchloroethylene.

4. The method of claim 1 wherein the solvent is at room temperature or is between 65° F. and 150° F.

5. The method of claim 1 wherein the stain:solvent ratio is from about 1:30 to 1:5.

6. The method of claim 1 wherein the stain:solvent ratio is about 1:10.

7. The method of claim 1 wherein the range of fabric:solvent ratio is from about 1:3 to about 1:50, and preferably about 1:5.

8. The method of claim 1 wherein the dry cleaning machine is loaded so as to allow for full wetting of said fabric or garment.

9. The method of claim 1 wherein the fabric or garment, solvent and stain are agitated or submerged in the dry cleaning machine for a period necessary for full saturation of said fabric or garment.

10. The method of claim 1 wherein the stained fabric or garment is extracted so as to remove excess solvent and stain to a wet pickup of between about 30 and 150%, and preferably 50–60%.

11. The method of claim 1 which further comprises the step of laundering and drying the washed fabric or garment.

12. A method of producing an antique looking and feeling fabric or garment which is durable to dry cleaning and home washing, comprising:

(a) staining said fabric or garment with a chlorinated dry cleaning solvent and a solvent-based stain in a petroleum dry cleaning machine substantially free of moisture for a period of time sufficient to fully saturate the fabric or garment;

(b) extracting said dry cleaned fabric or garment to remove excess solvent and stain to obtain a wet pickup in a desired range; and (c) drying said extracted fabric or garment in a forced hot air environment so as to set in the stain and cause the remaining solvent and stain to migrate to the surface of the fabric or garment.

13. The method of claim 12, wherein the solvent is perchloroethylene.

* * * * *